United States Patent [19]

O'Connor et al.

[11] Patent Number: 4,716,802

[45] Date of Patent: Jan. 5, 1988

[54] SCRAP REDUCTION SYSTEM FOR ROTARY DIE CUTTER

[75] Inventors: Barry J. O'Connor, Anderson, Ind.; Robert B. Vigder, Dayton, Ohio

[73] Assignee: Corfine Inc., Muncie, Ind.

[21] Appl. No.: 51,262

[22] Filed: May 5, 1987

Related U.S. Application Data

[63] Continuation of Ser. No. 817,720, Jan. 20, 1986, abandoned.

[51] Int. Cl.[4] ..... B26D 1/62; B26D 5/00; B65H 20/32

[52] U.S. Cl. ..... 83/313; 83/38; 83/336; 226/145; 226/148

[58] Field of Search ..... 83/38, 313, 336; 226/113, 114, 115, 117, 145, 148

[56] References Cited

U.S. PATENT DOCUMENTS

| | | | |
|---|---|---|---|
| Re. 27,139 | 6/1971 | Sarka | 83/38 |
| 2,273,265 | 2/1942 | Heyel . | |
| 2,306,501 | 12/1942 | Rouan et al. . | |
| 2,332,152 | 10/1943 | Knauer . | |
| 2,342,049 | 2/1944 | Holmbeck | 226/148 X |
| 3,548,747 | 12/1970 | D'Amato | 101/153 |
| 3,756,149 | 9/1973 | Bishop | 101/228 |
| 3,926,097 | 12/1975 | Santa Maria | 83/313 X |
| 4,014,233 | 3/1977 | Wolfinger et al. | 83/156 |
| 4,153,191 | 5/1979 | Bishop | 226/143 |
| 4,262,568 | 4/1981 | Wallis | 83/176 |
| 4,372,206 | 2/1983 | Tison et al. | 101/228 |
| 4,397,203 | 8/1983 | Brack et al. | 83/156 |
| 4,416,200 | 11/1983 | Yon | 101/228 |

*Primary Examiner*—Donald R. Schran
*Attorney, Agent, or Firm*—Biebel, French & Nauman

[57] ABSTRACT

A rotary die cutter system the amount of scrap between successive blanks cut from web material by holding the web against backward movement at a position spaced upstream from the nip defined by the die and anvil cylinders, retracting the cut leading end of the web through a predetermined distance in response to release of the web by the cut-off knife at the trailing edge of the die on the die cylinder such that on the next cycle, the leading edge of the die will engage the web at a position spaced close to the leading end of the web.

9 Claims, 4 Drawing Figures

SCRAP REDUCTION SYSTEM FOR ROTARY DIE CUTTER

REFERENCE TO RELATED APPLICATION

This is a continuation of co-pending application Ser. No. 817,720, filed Jan. 20, 1986 now abandoned.

BACKGROUND OF THE INVENTION

This invention relates to a rotary die cutting system which is fed by web stock and more particularly to a system for reducing the scrap material produced by rotary die cutters between successive blanks treated or cut from the web.

In conventional rotary die cutter systems, wherein the web stock is fed by powered pull rolls operating in synchronism with the die and anvil cylinders, the web is fed intermittently to maintain approximately the same accumulated loop of web material.

One of the problems with this conventional technique is that after the trailing edge of the die, which includes a cut-off knife, has cut off the portion of the web which passed between the die and the anvil cylinders, momentum tends to feed the cut edge of the web forward so that there will be a substantial area of the web lying beyond the point at which the leading end of the die will again strike the web. All of the material in advance of the line where the die will make contact during the next cycle will be scrap.

Accordingly, there is a need for a mechanism which when combined with a rotary die cutter, reduces the amount of web material which lies beyond the point where the leading edge of the die, upon rotation of the circular die cutter, strikes the web, and thereby reduces the amount of scrap web material produced.

SUMMARY OF THE INVENTION

The present invention provides for retracting the severed leading end of the web from a position beyond the nip of the rotary die cutter to a position in such relation to the nip that the leading end of the web will lie just beyond the point at which the web will be engaged by the leading edge of the die on the next cutting cycle.

Specifically, the present invention provides a device which includes a floating part so mounted that when the web is pulled forward by the pressure between the die cylinder and the anvil cylinder blanket during a die cutting cycle, the web will be sufficiently tensional to assure an essentially horizontal position with the floating part on top of the web material. As soon as the severing cut across the web is made upon completion of the particular die cycle, this part will return to a position below the line of feed of the web, thereby retracting the severed new leading end of the web by a predetermined amount.

This retraction preferably will be such that the new leading end of the web will lie just beyond, in the direction of web feed, the line at which the web will be engaged by the leading edge of the die during the next cycle. Upon engagement of the web by the die, the web loop will then again be pulled straight, which will return the floating part to its raised position during the next die cutting cycle.

The primary object of this invention, therefore, is to provide means for reducing the amount of scrap produced during successive cycles of a rotary die cutter operating on web material; and to provide means for precisely controlling the amount of severed web material retracted from a position beyond the nip of the die cylinder and the anvil cylinder to a position in such relation to the nip that the leading edge of the die will engage the web just behind its leading end.

Other objects and advantages of the invention will be apparent from the following description, the accompanying drawings and the appended claims.

DESCRIPTION OF THE PREFERRED EMBODIMENT

Figure 1:
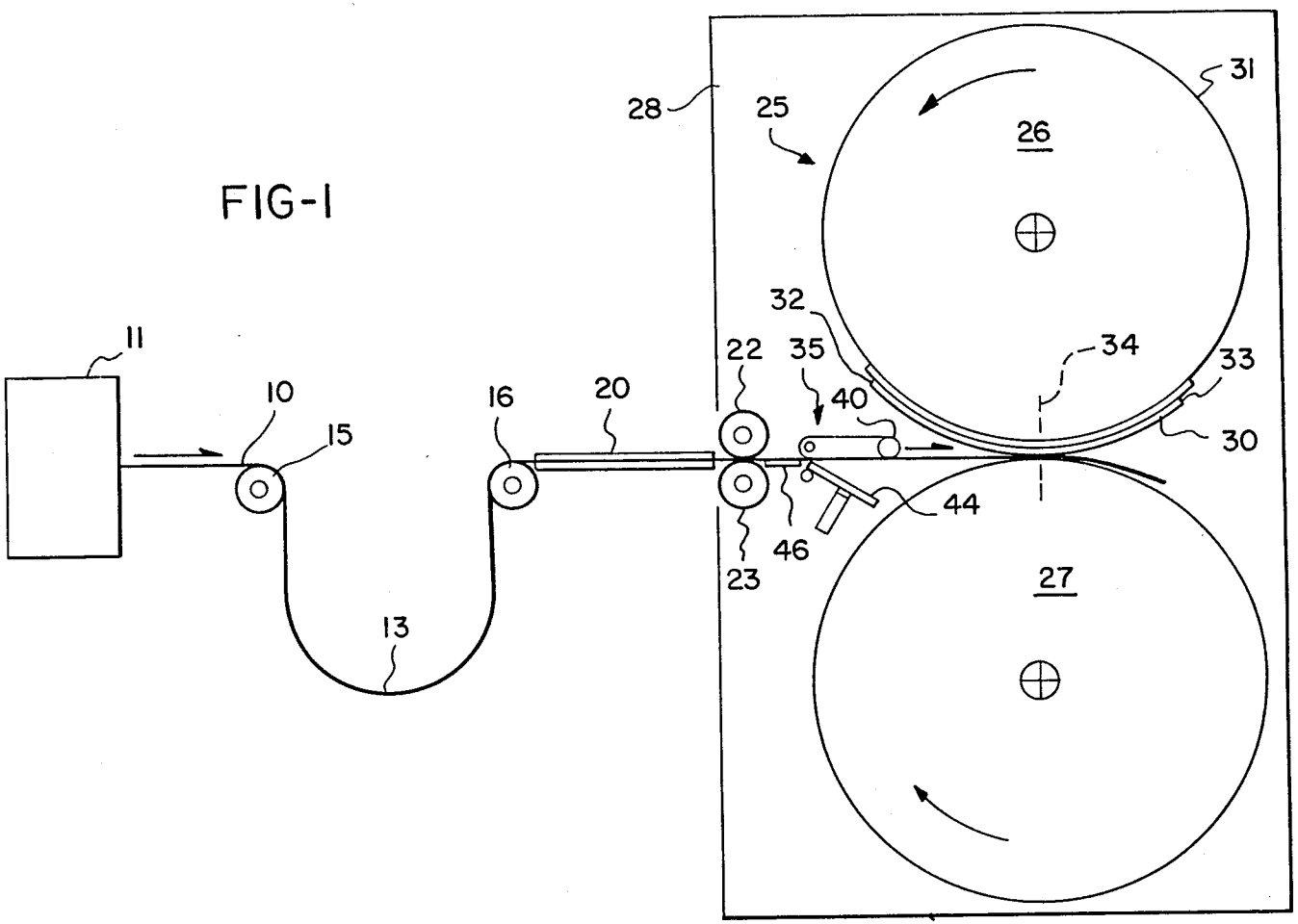
FIG. 1 is a schematic illustration of a die cutter line embodying the present invention and showing the parts during a die-cutting operation.

As shown in FIG. 1, the web 10 is supplied under tension from a roll or material processor shown schematically as a station 11 by conventional means such as driven pull rolls (not shown). The driving of the pull rolls is controlled in a conventional manner whereby a slack loop 13 is maintained in the web 10 between two idler rollers 15–16.

The web 10 drawn from the slack loop 13 is fed over a guide table or material support tray 20 and between a pair of pinch rolls 22–23 to the rotary die cutter 25, which comprises an upper die cylinder 26 and a lower anvil cylinder 27 rotatably mounted in the usual nip defining relation in suitable end frames 28. The anvil cylinder 27 may be a plain metal cylinder or may be provided with a conventional blanket of elastomeric or other protective material. The pinch rolls 22–23 are idler rolls in pressure engagement with the web 10, but they are provided with one-way clutches of any conventional construction which permit them to rotate only in the direction of advance movement of the web so that they hold the web against reverse movement toward the loop 13.

The movement of the web through the rotary die cutter 25 is effected by the direct pull applied to the web by the die 30 on the anvil cylinder 27, which grips the leading end portion of the web against the anvil cylinder 27. As illustrated in FIG. 1, the die 30 extends only part way around the circumference of die cylinder 26, so that each of the blanks to be cut from the web 10 by the die cutter 25 is of a length less than the circumferential dimension of the die cylinder 26. There will therefore be a gap 31 on the surface of the die cylinder 26 between the trailing and leading edges of the die 30.

The die 30 may be of any steel rule or other conventional type, which will include a cut-off knife 32 on its trailing edge for cutting the completed blank and any scrap material on either side of it free of the web behind it. There will also usually be a cut-off knife 33 at the leading edge of the die for cutting off the scrap material immediately in advance of the line on which this leading cut-off knife strikes the web. As described below in connection with FIGS. 2 and 3, the leading edge knife 33 on the die 30 will engage the web on the surface of anvil cylinder 27 ahead of the nip line 34 of the two cylinders. Similarly, the trailing edge knife 32 will engage the web beyond the nip line 34. Inherently, therefore, unless some provision is made to prevent it, the portion of the web lying between those two positions at the end of the cutting portion of each cycle will become scrap.

During each portion of a cycle of the die cutter while the gap 31 is opposite the anvil cylinder, the die cutter is not applying a pulling force to the web. However, there will be a tendency for momentum to propel the cut leading end of the web forward. In addition, since this free leading portion of the web is resting on the constantly rotating surface of the anvil cylinder 27, frictional engagement therebetween will also cause forward movement of the leading end of the web.

As a result of this combination of forces, it has been found that unless special provision is made to prevent it, a substantial portion of the leading end of the web will travel beyond the nip line 34 of the two cylinders 26–27 before the leading end of the die 30 again engages the web. All this material which lies forward of the line where the knife 33 at the leading end of the die next engages the web will become scrap. The essential purpose of the present invention is to minimize the amount of that scrap by controlled retraction of the leading end of the web during that portion of each cycle of the die cutter when there is no pressure engagement between its two cylinders.

As schematically illustrated in FIG. 1, in accordance with the present invention, a retraction or back-up device 35 is provided at a position spaced between the pressure rolls 22–23 and the two cylinders 26–27. The hack-up device 35 functions to retract that portion of the web material which has passed beyond the nip line 34 of the die cylinder 26 and anvil cylinder 27 back toward the pressure rolls 22–23 immediately after the trailing edge knife 32 of the die 30 has severed the latest blank and released the web.

This back-up device 35 comprises a cylindrical bar 40 rotatably mounted at one end of each of a pair of pivot arms 41 which are in turn pivotally mounted at 42 on the end frames 28 so that the bar 40 can effectively float in operation as described below. Downward movement of the bar 40 and arms 41 about the pivotal mountings 42 is limited by a tray 44 pivotally mounted at 45 in the end frames 28 below the pivotal mountings 42 and just forward of a fixed support tray 46. Adjustment of the tray 44 is effected by adjusting screws 47 threaded in brackets 48 mounted on the end frames 28.

Figure 2:
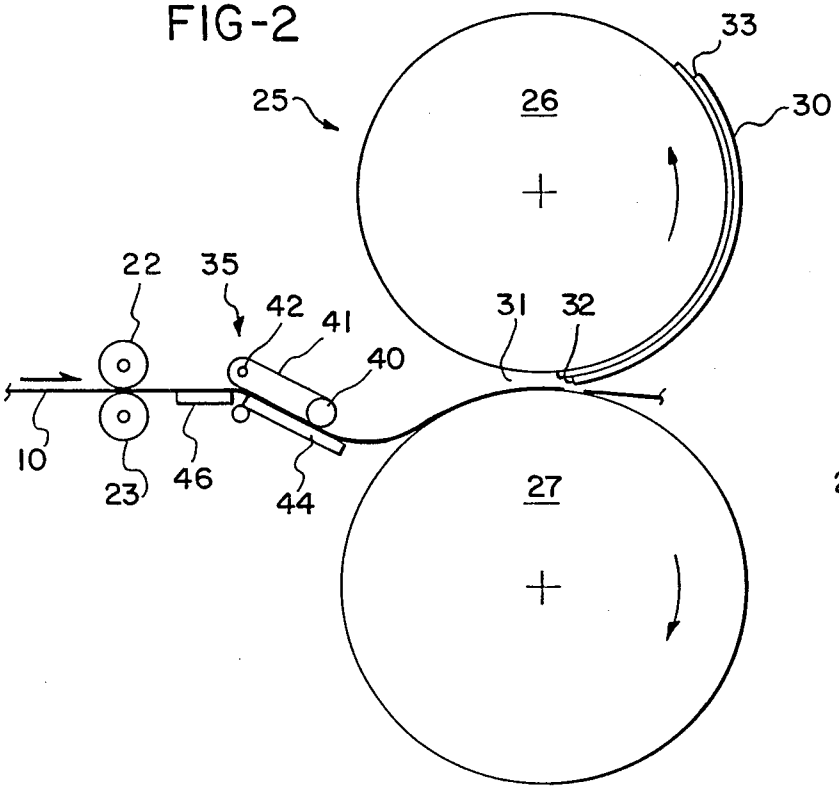
FIG. 2 is a fragment of FIG. 1 showing the trailing end of the die just after disengagement from the web.
Figure 4:
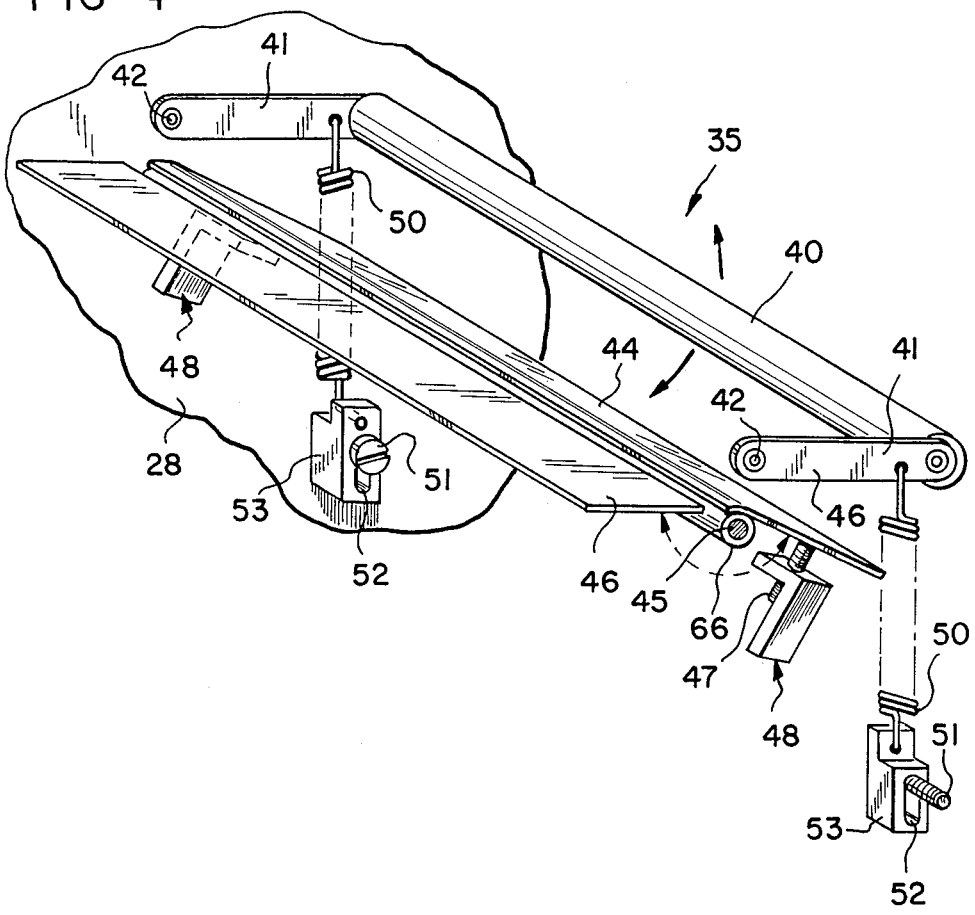
FIG. 4 is a perspective view of the assembly for retracting the leading end of the web after its release by the trailing edge of the die.

In operation, as illustrated in FIGS. 1–2, the web 10 is threaded below the bar 40, and its tension will cause the bar 40 to float, with the arms 41 horizontal, so long as the web is being pulled forward by engagement between the die 30 and anvil cylinder 27. In the absence of the taut web, gravity would cause the arms 41 to pivot downwardly until the bar 40 rests on the tray 44, and each arm 41 is also provided with a biasing tension spring 50 for augmenting the gravity force. The lower end of each spring 50 is adjustably mounted on the adjacent frame 28 by a screw 51 in a slot 52 in the block 53 to which the lower end of the spring 50 is attached.

FIG. 1 illustrates the relative positions of the parts of the system during a die-cutting operation, with the die 30 in pressure engagement with the anvil cylinder 27 to pull the web forward while it is cutting a blank therefrom. As shown, the tension on that portion of the web between the rolls 22–23 and the nip of die 30 with anvil cylinder 27 pulls that web portion essentially straight, thereby raising the bar 40 against the force of springs 50 and gravity to the position wherein its supporting arms 41 are essentially horizontal.

FIG. 2 shows the relative positions of the parts immediately following completion of the die-cutting operation. The trailing end of that portion of the web from which a blank has been cut has been cut off, as indicated at 55, and the resulting new leading end of the web is now no longer gripped between opposed portions of the die and anvil cylinders. There is therefore no tension on that part of the web forward of the pressure rolls 22–23, which hold that web length against retraction into the loop 13 by reason of this one-way clutches as previously described.

The bar 40 accordingly drops, under the combined forces of gravity and the springs 50, until it is stopped by the tray 44. During this movement, it will carry with it that portion of the web on which it is resting, thereby retracting the leading end of the web as shown in FIG. 2 to produce a corresponding downward loop 60 of web forward of the pivotal mountings 42 for the arms 41.

Figure 3:
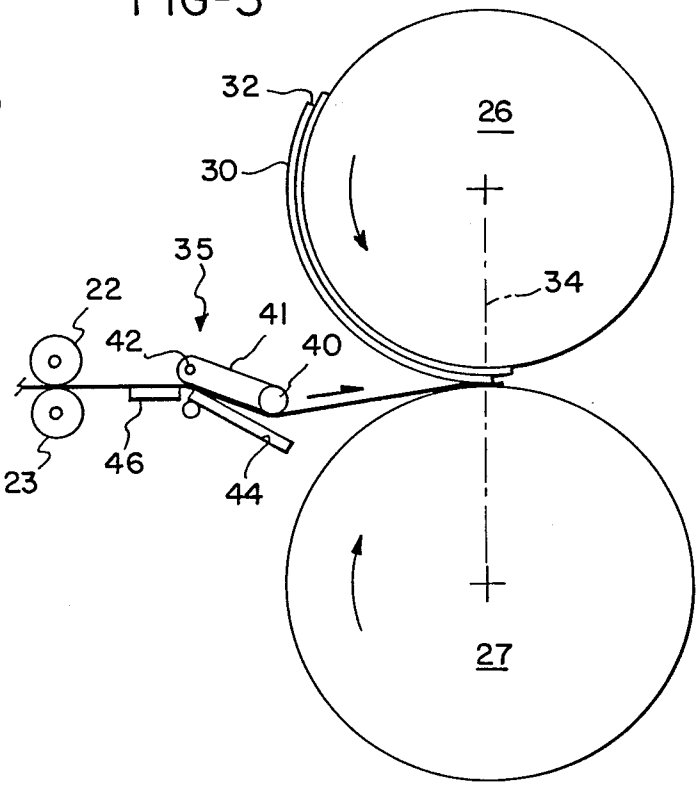
FIG. 3 is a view similar to FIG. 2 showing the positions of the parts immediately after the leading edge of the die engages the leading end of the web.

As previously pointed out, and as illustrated in FIG. 2, the trailing edge knife 32 will cut off the blank along a line beyond the nip line 34. Similarly, and as illustrated in FIG. 3, the leading edge knife 33 on the die will engage the web along a line in advance of the nip line 34. The retracted position of the bar 40 is therefore preferably so established, by adjustment of the tray 44 as previously described, that the new leading end of the web will lie just beyond the angular position on the anvil roll 27 which will be engaged by the leading edge knife 33 at the start of the next cutting cycle.

FIG. 3 illustrates the relative position of the parts just after that point in the cycle, with the leading end of the web now gripped between the die 30 and the anvil cylinder so that the loop 60 of web previously produced by the bar 40 is being straightened out until the web is restored to the horizontal position shown in FIG. 1.

In summary, the complete cycle can be visualized as running from the rest position illustrated in FIG. 2 through the positions illustrated in FIG. 3 and FIG. 1 back to the rest position, which extends for the entire portion of the cycle represented by the space 31 where there is no die on the die cylinder 26. The adjustments provided by the adjusting screws 47, 51 for the tray 44 for the spring mounting blocks 53 may be employed as desired or needed in accordance with properties of the particular web being cut such as thickness, stiffness, flexibilty and friction engagement with the anvil cylinder 27.

Thus for a material such as thin plastic film, the extra biasing force of the springs 50 may not be needed, but for relatively heavy web materials, the additional downward biasing force on the bar 40 may be essential to effect adequate retraction of the leading end of the web. Experience with practical applications of the invention has shown that where in the absence of the invention, the scrap material ranged from two inches in the direction of the web length to as high as six inches per cycle, the practice of the invention has made it possible to reduce that dimension to or less than one inch.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a die cutter system for cutting succesive blanks from advancing web material, said system including a pair of die and anvil rolls mounted in a frame in nip-defining relation which cooperate to grip and pull a leading end portion of the web forward while cutting a blank therefrom and which release the cut leading end of the web during a portion of each complete revolution, and said system also including means for feeding the web to said rolls, and means for maintaining a slack loop of web between said feeding means and said rolls whereby said rolls grip and pull the web from said slack loop, apparatus for minimizing the scrap web material between successive blanks, comprising:

(a) one-way means at a position spaced upstream from the nip defined by said rolls and downstream from said loop maintaining means for holding the web against backward movement into said slack loop, (b) means positioned between said holding means and said nip for retracting the cut leading end of the web through a predetermined distance with respect to said nip in response to release of the web by said rolls, and (c) means for controlling said retracting means to limit said retracting action thereof such that the cut leading end of the web will lie just beyond the angular position on said anvil roll where said die roll will engage said anvil roll at the start of the next cutting cycle and will thereby engage and draw the web through said nip.

2. The system defined in claim 1 wherein said retracting means comprises means for forming the leading end portion of the web into a loop.

3. The system defined in claim 2 further comprising means for adjusting said loop-forming means to regulate the size of the loop and the extent of retraction of the cut leading end of the web.

4. The system defined in claim 2 wherein said retracting means comprises a bar extending across the path of the web, and means mounting said bar on said frame for movement between a raised position wherein said bar is supported by the web while the web is being pulled forward by said cylinders and a lowered position wherein said bar depresses into a loop the portion of the web therebelow.

5. The system defined in claim 4 further comprising means for adjusting the location of said lowered position of said bar to effect corresponding control of the size of said loop and the extent of retraction of the cut leading end of the web.

6. The system defined in claim 4 further comprising means for applying a downward biasing force to said bar.

7. The system defined in claim 2 wherein said retracting means comprises a bar extending across the path of the web, and pivoted arm means mounting said bar on said frame for swinging movement between a raised position wherein said bar is supported by the web while the web is pulled forward by said cylinders and a lowered position wherein said bar depresses said web portion into a loop.

8. The system defined in claim 7 further comprising stop means establishing said lowered position of said bar, and means for adjusting said stop means to regulate the extent of retraction of the cut leading end of the web.

9. The system defined in claim 1 wherein said web holding means comprises a pair of idler rolls defining a pressure nip through which the web passes, and one-way clutch means limiting rotation of said idler rolls to the direction of forward movement of the web.

* * * * *

UNITED STATES PATENT AND TRADEMARK OFFICE

CERTIFICATE OF CORRECTION

PATENT NO. : 4,716,802

DATED : January 5, 1988

INVENTOR(S) : Barry J. O'Connor and Robert B. Vigder

It is certified that error appears in the above-identified patent and that said Letters Patent is hereby corrected as shown below:

ABSTRACT

Line 1, "minimizes" should be inserted after --system--.

Column 3, line 34, "hack-up" should be --back-up--.

Signed and Sealed this

Twelfth Day of July, 1988

*Attest:*

*Attesting Officer*

DONALD J. QUIGG

*Commissioner of Patents and Trademarks*